United States Patent [19]

Taylor, Jr. et al.

[11] 4,453,065

[45] Jun. 5, 1984

[54] MICROWAVE OVEN DOOR ALIGNING ASSEMBLY

[75] Inventors: Benson T. Taylor, Jr., Floyd Knobs, Ind.; Ralph G. Hawkins, Louisville, Ky.

[73] Assignee: General Electric Company, Louisville, Ky.

[21] Appl. No.: 378,955

[22] Filed: May 17, 1982

[51] Int. Cl.[3] ..... H05B 6/76

[52] U.S. Cl. ..... 219/10.55 D; 219/10.55 C; 126/197; 292/DIG. 55

[58] Field of Search ..... 219/10.55 C, 10.55 D, 219/10.55 R; 292/DIG. 55, DIG. 39, 341.18, 341.19; 248/558, 27.1, 27.3; 126/197; 339/126 R, 128

[56] References Cited

U.S. PATENT DOCUMENTS

| | | | |
|---|---|---|---|
| 3,397,934 | 8/1968 | Dushek | 312/351 |
| 3,415,155 | 12/1968 | Riddell et al. | 85/80 |
| 3,715,552 | 2/1973 | Umezu et al. | 219/10.55 |
| 3,777,098 | 12/1973 | Tapper | 219/10.55 |
| 3,865,097 | 2/1975 | Robinson | 126/197 |
| 3,893,365 | 7/1975 | Gross | 85/80 |
| 3,972,550 | 8/1976 | Boughton et al. | 292/288 |
| 4,101,750 | 7/1978 | Doner | 219/10.55 |
| 4,192,477 | 3/1980 | Decky et al. | 248/56 |

*Primary Examiner*—B. A. Reynolds
*Assistant Examiner*—Philip H. Leung
*Attorney, Agent, or Firm*—Frederick P. Weidner; Radford M. Reams

[57] ABSTRACT

A microwave oven door aligning assembly is provided and includes a centering prong rigidly mounted on the door of the oven and projecting beyond the inside surface of the door. A clip is mounted to the oven behind the front face of the oven cavity and the clip has an opening in alignment with an opening in the front face. A centering prong receiving receptacle having a rigid square body portion is removably inserted into the clip opening and secured to the clip. The receptacle has a square opening to receive the centering prong which opening is offset from the center of the receptacle such that two opposite sides of the opening are equal distance from the center and the other two opposite sides of the opening are of unequal distance from the center. With this arrangement the receptacle may be rotatably installed to assure proper parallel alignment of the door relative to the top and bottom cabinet walls by cooperation between the centering prong and the receptacle.

5 Claims, 5 Drawing Figures

MICROWAVE OVEN DOOR ALIGNING ASSEMBLY

BACKGROUND OF THE INVENTION

The present invention relates to a door aligning assembly and particularly a door aligning assembly for use with a microwave oven.

In the conventional microwave oven, a microwave energy generating device is provided for delivering microwave energy into a cavity defined by a cabinet having a front opening selectively closed by a door. To assure there is no leakage of the microwave energy from the cavity during operation of the oven, it is important that access to the oven cavity by the user is prevented when the microwave energy generating means is energized. Thus, it is conventional to provide interlocking means for assuring that the cabinet door is in the closed and latched position before the microwave energy generating means may be energized. A number of different interlocking systems have been developed to provide such functioning. Most commonly is a mechanism wherein a latch secured to the door will engage a switch secured to the oven which switch will energize the microwave energy generating device only when the door is in its closed position and when opened and the latch removed from contact with the switch the microwave energy generating device is de-energized. See for example U.S. Pat. Nos. 3,715,552; 3,777,098; 3,865,097 and 4,101,750.

To aid in the proper functioning of the interlocking system it is important that the door be properly aligned relative to the cabinet to assure that the door and the latches on the door properly actuate the switch that energizes and de-energizes the microwave energy generating device respectively. Door alignment can be a problem since the door in most microwave ovens is rectangular shaped and is relatively heavy so that proper door alignment particularly at the end of the door away from the hinges is difficult to achieve during assembly of the microwave oven. To aid in proper alignment of the door relative to the microwave oven cavity, a centering prong or guide projection may be used. For example, in U.S. Pat. No. 3,777,098 there is provided a guide projection adapted to extend through an aperture in the front face of the oven and guided by rollers rotatably mounted at the upper and lower sides of the aperture.

In some microwave ovens it may be desirable to include a switch actuated and deactuated by the centering prong when the microwave oven door is in its fully closed position. Often times this switch is a safety switch provided to terminate all electrical power in the microwave oven in the event that the switch or switches of the interlocking system has failed in a closed condition.

By this invention there is provided a door aligning assembly and switch arrangement for microwave ovens which assures that the door is correctly aligned relative to the cabinet so that the door properly actuates and deactuates the switches that energizes and de-energizes the microwave energy generating device respectfully and also provides a means for terminating all electrical power to the appliance.

SUMMARY OF THE INVENTION

In a microwave oven having a cabinet with top, bottom, rear and side walls defining an oven cavity with an opening in the front face thereof, a door movably mounted to said cabinet by hinges for selectively closing said opening, electrically operable microwave energy generating means for supplying microwave energy to said cavity, and an electrically operable circuit including switch means for providing electric power from an external source to said electrically operable microwave energy generating means, and a door aligning assembly for properly maintaining the door in parallel alignment relative to the top and bottom walls, the improvement including the following door aligning assembly. There is a centering prong rigidly mounted on the door and projecting beyond the inside surface of the door. An opening in the front face of the oven remote from the door hinges is also provided and a clip is mounted to the oven behind the front face, said clip having an opening in alignment with the front face opening. A centering prong receiving receptacle having a rigid square body portion is movably inserted in the clip opening and means to secure the receptacle to the clip is provided. Said receptacle has a square opening to receive the centering prong which opening is offset from the center of the receptacle such that two opposite sides are equal distance from the center and the other two opposite sides are of unequal distance from the center. With this arrangement the centering prong receiving receptacle may be properly oriented relative to the clip opening to provide parallel alignment of the door relative to the top and bottom cabinet walls by cooperation between the centering prong and the receptacle.

DESCRIPTION OF THE PREFERRED EMBODIMENT

Figure 1:
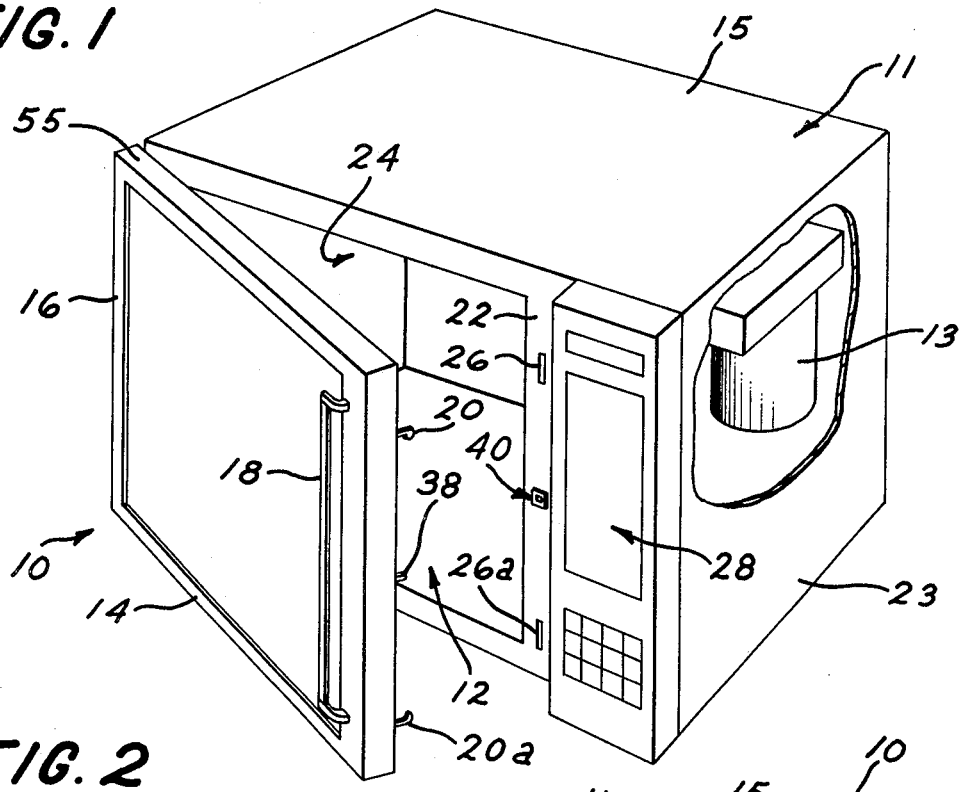
FIG. 1 is a perspective view of a countertop microwave oven with the door open showing a portion of the door aligning assembly of the present invention.
Figure 2:
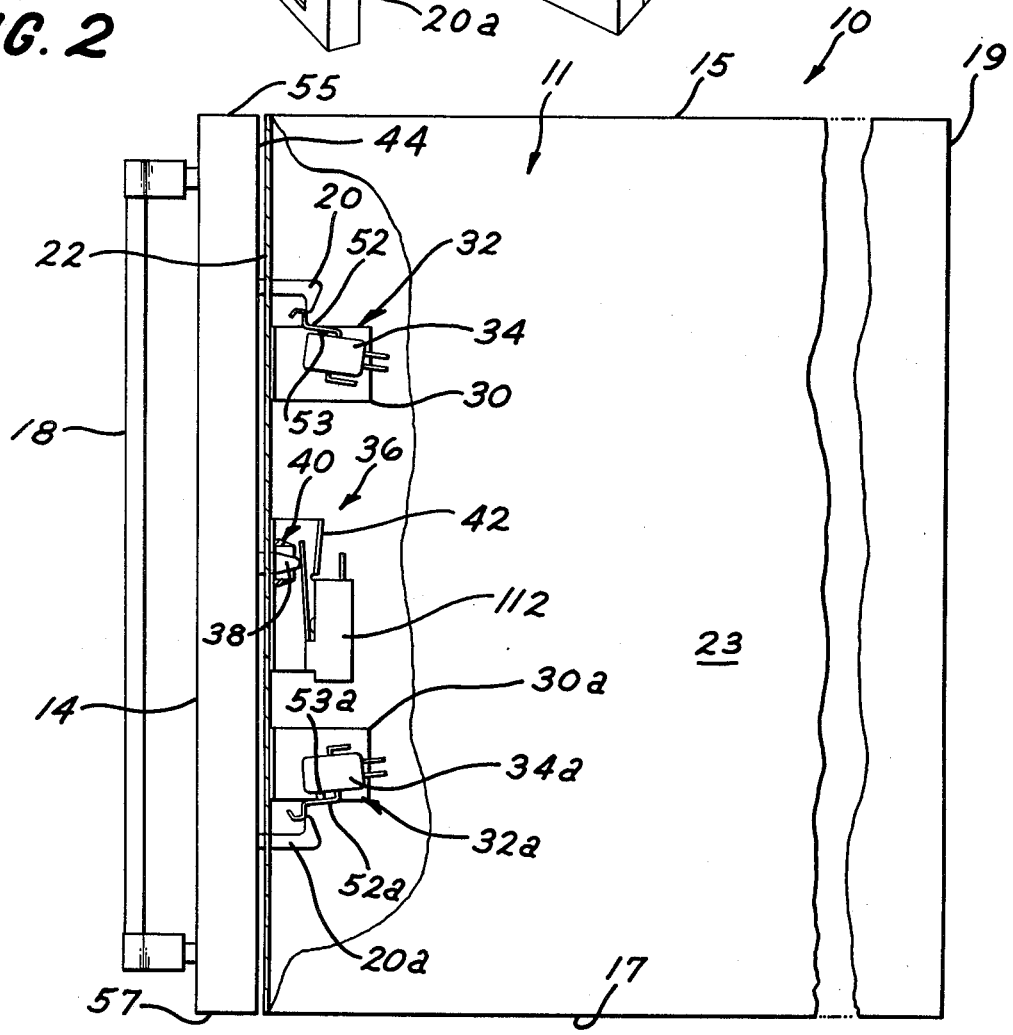
FIG. 2 is a side elevational view of the countertop microwave oven shown in FIG. 1 with a portion of the cabinet broken away to shown the door aligning assembly when the door is closed.

Referring to FIGS. 1 and 2, there is shown a microwave oven 10 comprising an outer casing or cabinet 11 having a top wall 15, bottom wall 17, rear wall 19 and opposite side walls 23, only one of which is shown in the drawing, enclosing a cooking cavity 12. An electrically operable microwave energy generating means 13 is provided for supplying microwave energy to the cavity 12 in the conventional manner. The front opening 24 of the cavity 12 is closed by door 14 hinged at one end 16 and having a handle 18 at the opposite end with latches 20 and **20*a* which project through the inner liner of the door and are received through the front face 22 that surrounds the opening 24 through slot openings 26 and 26*a*** respectively when the door is in its closed position.

The front of the microwave oven 10 has a control panel 28 so that the user may control the energization and de-energization of the microwave energy generating means 13 when the door is closed and also select the desired mode of cooking. Behind and welded or otherwise attached to the front face 22 of the microwave oven 10 are rigid oven mounting members 30 and 30*a*, each of which have a portion adjacent to the control panel 28. As seen in FIG. 2, attached to the oven mounting members 30 and 30*a* behind the slot openings 26 and 26*a* are switch assemblies 32 and 32*a*. The switch assemblies 32 and 32*a* include switches 34 and 34*a* rigidly secured to the oven mounting members 30 and 30*a*. The oven mounting members 30 and 30*a* and switch assemblies 32 and 32*a* are identical as far as concerning this invention and are mounted in the oven in an opposing manner. They do operate in an identical manner even though the respective switches may serve different purposes. In the preferred embodiment of the microwave oven there are two switch assemblies 32 and 32*a* used in the interlocking system, however, in some microwave ovens only one switch assembly may be used. In the preferred embodiment switch assembly 32 is utilized in the interlocking system of the microwave oven to energize and de-energize the microwave energy generating means when the door is closed and properly latched and when the door is open and unlatched respectively. Switch assembly 32*a* is utilized to enable and disenable the electronic control system of the microwave oven when the door is closed and properly latched and when the door is open and unlatched respectively. The switch assemblies 32 and 32*a* are actuated by latch pawls 20 and 20*a* resepctively. The switches 34 and 34*a* have an actuating arm 52 and 52*a* respectively which is utilized in the usual manner such that the depression of the actuating arm depresses a button 53 and 53*a* that actuates the switch and release of the actuating arm releases the button and deactuates the switch. By a suitable latching and unlatching arrangement responsive to closing the door 14 the latch pawls 20 and 20*a* pass through the openings 26 and 26*a* in the front face 22 of the microwave oven and when the door is firmly closed the latch pawls depress the actuating arms 52 and 52*a* of the switches 34 and 34*a* thus actuating the switches. When the user opens the door with the handle 18 the latch pawls 20 and 20*a* are moved out of contact with the actuating arms 52 and 52*a* and when the door is opened the switches 34 and 34*a* are deactuated.

It is important in the interlocking system for a microwave oven that the door carrying the latching and unlatching mechanism be precisely aligned with the cavity 24 of the oven so that upon closing the door the latch pawls 20 and 20*a* are correctly and precisely oriented relative to the actuating arms 52 and 52*a* and the interlocking system functions properly. Some difficulty in proper alignment of the door relative to the oven cavity during assembly of the microwave oven and subsequent extensive opening and closing of the door can be experienced. Door 14 is rectangular shaped and relatively heavy so that during assembly precise parallel alignment of the door relative to the top and bottom cabinet walls and at the same time securing the door by the hinges is difficult. It will be understood that when the microwave oven is assembled that if the top surface 55 and bottom surface 57 of door 14 are parallel to the top wall 15 and bottom wall 17 when the hinged door is closed that the door 14 will be properly aligned with cavity 24 and not only display good aesthetics but also the latch pawls 20 and 20*a* will be precisely oriented relative to the actuating arms 52 and 52*a* for proper interlocking system functioning.

Figure 3:
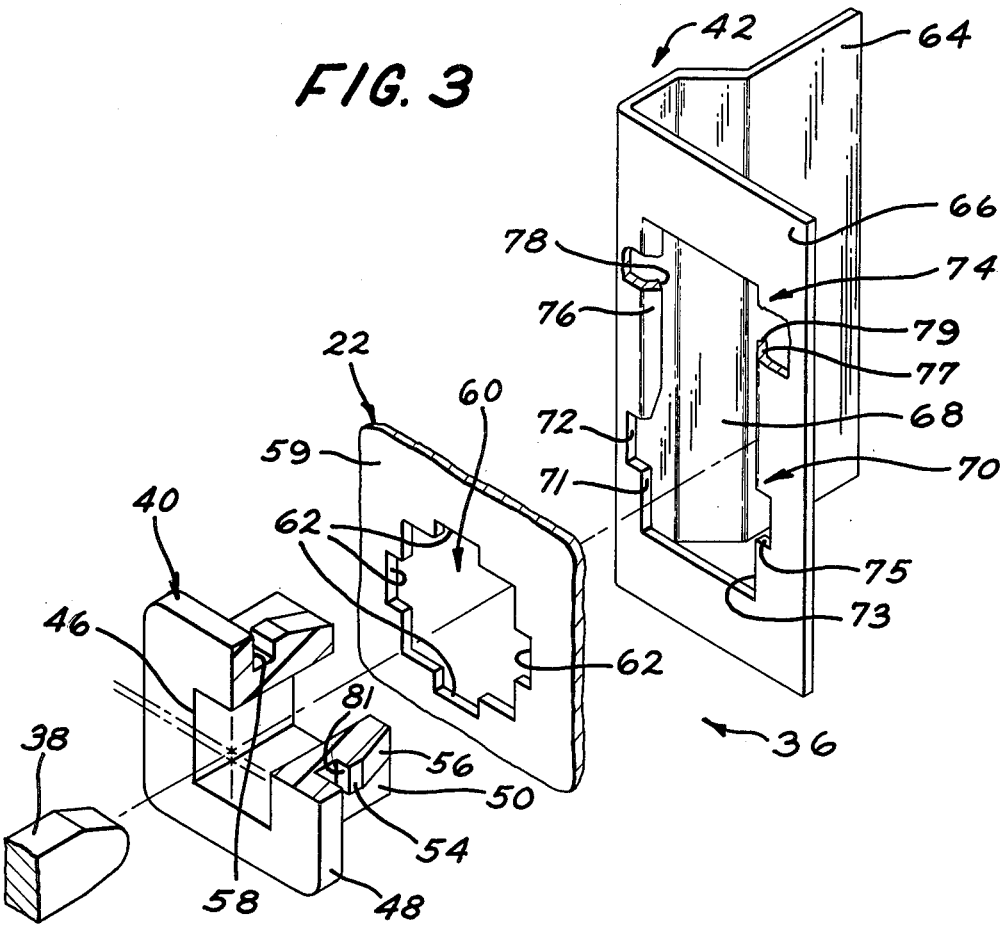
FIG. 3 is an exploded perspective view of the door aligning assembly of the present invention.

To aid in properly aligning the door 14 relative to the cavity 24 of the microwave oven there is provided by this invention a door aligning assembly 36. With reference to FIG. 3 the door aligning assembly 36 includes a centering prong 38, a centering prong receiving receptacle 40, and a clip 42. The centering prong 38 is rigidly mounted on the door and projects beyond the inside surface 44 of the door. The centering prong receiving receptacle 40 has a square opening 46 therethrough and has a peripheral flange 48 surrounding the square opening 46. The rear portion 50 of the receptacle 40 is also square and surrounds the square opening 46 and has on each side ears 54 that have an inclined surface 56 and a shoulder surface 80. The shoulder surfaces 80 of ears 54 are spaced from the rear surface 58 of the flange 48, the purpose of which will be discussed later.

The centering prong receiving receptacle 40 is received in an opening 60 of the front face 22 of the oven which opening 60 is configured to receive the rear portion 50 of the receptacle therethrough and includes cutout portions 62 on each side of the square opening 60 so that the ears 54 of the receptacle 40 may pass therethrough. The square opening 60 is smaller in dimension than the outside dimension of the peripheral flange 48 so that the rear surface 58 of the flange 48 abuts the front surface 59 of front face 22 as particularly shown in FIG. 5.

Located behind the front face 22 and abutting the rear surface 63 thereof is the L-shaped clip 42 which has a leg 64 and a leg 66 that is at a right angle to and joined with the first leg 64 and has a rectangular shaped opening 68. A first portion 70 of the rectangular opening 68 is located at the bottom half of the rectangular shaped opening and the opposite sides 71 and 73 of the first portion 70 opening have cutouts 72 and 75 respectively. The first portion 70 of the opening 68 is dimensioned to receive therethrough the rear portion 50 of the receptacle 40 and the cutouts 72 and 75 allow for the ears 54 to pass through the opening. The second portion 74 of the rectangular opening 68 is located at the top half of the opening and the clip 42 has depending lips 76 and 77 on each side of the opening 68 which depending lips extend rearwardly from leg 66.

Figure 5:
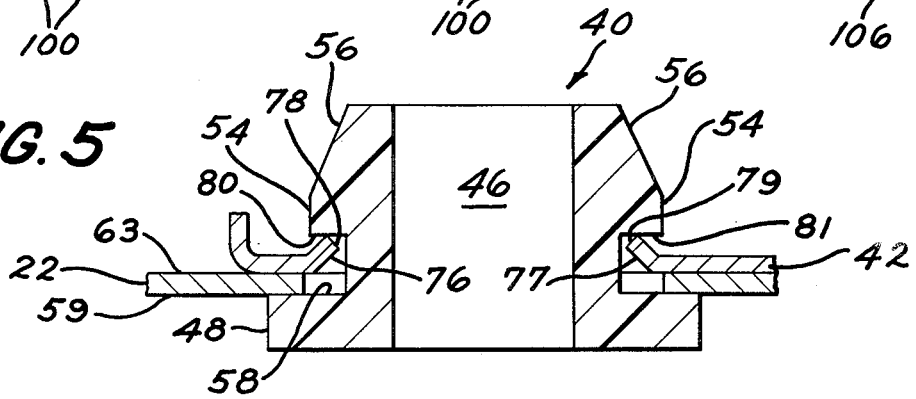
FIG. 5 is a cross-sectional view of the centering prong receiving receptacle retained on the clip of the present door aligning assembly.

To assemble the door alignment assembly 36 the receptacle 40 is passed through the opening 60 in the front face 22 of the microwave oven as previously described and the clip 42 is located such as to have its first portion 70 of the rectangular opening 68 behind the opening 60 in the front face as shown in FIG. 3. After the rear portion 50 of the receptacle 40 passes through the first portion 70 and the rear surface 58 of the flange 48 of the receptacle 40 abuts the front face 22 the clip 42 is moved vertically downwardly (as viewed in FIG. 3) whereupon the depending lips 76 and 77 having terminal ends 78 and 79 respectively bear agasint the shoulder surface 80 and 81 of the ears 54 of the receptacle 40 as shown in FIG. 5. Advantageously the terminal ends 78 and 79 of the lips 76 and 77 are slightly inclined from their ends adjacent the cutouts 72 and 75 of opening 68 in clip 42 to the opposite ends so that as the clip 42 is moved vertically downwardly (FIG. 3) thus moving the rear portion 50 into the second portion 74 of the opening 68 there is increased friction between the clip 42 and the receptacle 40. As most clearly shown in FIG.

5 the space between the shoulder surface 80 and 81 of the ears 54 and the rear surface 58 of the flange 48 of the receptacle is such that there is provided a tight frictional fit by accommodating the thickness of the front face 22 and the lips 76 and 77 of the clip 42. Thus, when the clip 42 is moved downwardly (FIG. 3) relative to the receptacle 40 there is a rigid frictional securement of the receptacle 40 to the clip 42.

Figure 4:
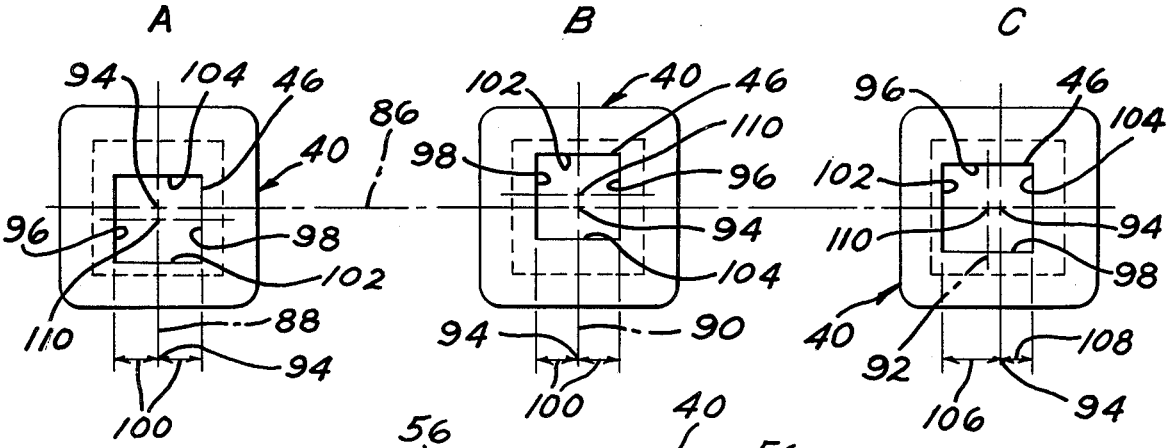
FIG. 4 is a front view of the centering prong receiving receptacle of the present invention showing three different orientation positions.

With particular reference to FIG. 4 the front view of the receptacle 40 is shown in three different positions, designated A, B and C, by rotating the receptacle. The center line of the receptacle is designated line 86 while the vertical center lines are designated in position A as 88, in position B as 90 and in position C as 92. It will be noted that the square opening 46 is offset from the center 94 of the receptacle 40 such that two opposite sides 96 and 98 of the square opening 46 are equal distance from the center 94 of the receptacle 40 and these equal distances are designated 100 in position A and B of FIG. 4. With reference to position C of FIG. 4, it will be noted that the other two opposite sides 102 and 104 are of unequal distances from the center 94 of the receptacle 40 and in the case of position C of FIG. 4 side 102 is a distance greater from the center 94 of the receptacle which distance is designated 106 while the opposite side 104 is a shorter distance from the center 94 which is designated 108. With the square opening 46 offset from the center 94 of the receptacle the center 110 of the opening 46 can be below the horizontal center line 86 as in position A or it may be above the center line 86 as shown in position B or it may coincide with the center line 86 as shown in position C.

It will be understood that by orienting the receptacle 40 to either of the three positions A, B or C shown in FIG. 4 and retained in the opening 60 of the front face 22 in the respective position that when the door 14 is closed and the rigid centering prong 38 passes into the opening 46 of the receptacle it may be guided up (position B), down (position A) or neutral (position C) depending upon the orientation of the receptacle 40 in opening 60 relative to the centering prong 38. Thus, during manufacture the assembler orients the receptacle correctly so that when the rigid centering prong is guided into the receptacle it will align the top surface 55 and bottom surface 57 of the door 14 parallel to the top and bottom cabinet walls 15 and 17 respectively and correctly position the door against the front face 22 of the microwave oven. In this manner proper door alignment is achieved and when so accomplished the first portion 70 of the rectangular opening 68 in the clip 42 is inserted over the rear portion 50 of the receptacle 40 and then moved downwardly to frictionally engage the receptacle 40 until the receptacle is located in the second portion 74 of the opening 68 resulting in securement of the receptacle 40 and clip 42 to the front face 22 of the microwave oven.

By this invention as described above there is provided an easy way to vertically move the end of the door remote from the hinges to provide proper parallel alignment of the door with the cabinet 11 and thereby assure that the latch pawls 20 and **20*a* carried by the door cooperate with the actuating arms 52 and 52*a* respectively of the switches 34 and 34*a* to provide proper functioning of the interlocking system of the microwave oven. It not only aids during the assembly of the microwave oven but in subsequent extended usage it assures that the door is always in proper parallel alignment with respect to the cabinet 11**.

In addition, it may be advantageous to have a switch 112 actuated by the centering prong 38 when the door 14 is completely closed and deactuate the switch 112 when the door is opened. The switch 112 may for instance be utilized as a safety backup switch in the event that switches 34 and **34*a* fail in the closed position. For instance, if the door is opened and the switches are still actuated, switch 112** will terminate all electrical power to the microwave oven.

While, in accordance with the patent statutes, there has been described what at present is considered to be the preferred embodiment of the invention. It will be obvious to those skilled in the art that various changes and modifications may be made thereto without departing from the invention. It is, therefore, intended by the appended claims to cover all such changes and modifications as fall within the true spirit and scope of the invention.

What is claimed is:

1. A microwave oven having a cabinet with top, bottom, rear and side walls defining an oven cavity with an opening in the front face thereof, a door movably mounted to said cabinet by hinges for selectively closing said opening, electrically operable microwave energy generating means for supplying microwave energy to said cavity, and an electrically operable circuit including switch means for providing electric power from an external source to said electrically operable microwave energy generating means, and a door aligning assembly for properly maintaining the door in parallel alignment relative to the top and bottom cabinet walls, the improvement comprising:

a centering prong rigidly mounted on the door and projecting beyond the inside surface of the door, an opening in the front face remote from the door hinges, a clip mounted to the oven behind the front face, said clip having an opening in alignment with the front face opening, a centering prong receiving receptacle having a rigid square body portion removably inserted in the clip opening and means to secure the receptacle to the clip, said receptacle having a square opening to receive the centering prong which opening is offset from the center of the receptacle such that two opposite sides of the opening are equal distance from the center and the other two opposite sides of the opening are of unequal distance from the center.

2. The microwave oven of claim 1 wherein the receptacle opening goes through the receptacle and a switch with an actuating arm is located behind the opening such that the centering prong actuates the switch upon door closing and deactuates the switch upon door opening.

3. The microwave oven of claim 1 wherein the centering prong receiving receptacle has a peripheral flange portion at one end thereof and having a dimension greater than the opening in the clip.

4. The microwave oven of claim 3 wherein the clip opening is a vertical elongated rectangle having a first portion and a second portion and the receptacle body has projecting ears spaced from the peripheral flange and the first portion of the clip opening has cutouts for receiving the ears for positioning the receptacle body therein and the receptacle is movable to the second portion of the clip opening to secure the receptacle to the clip.

5. The microwave oven of claim 4 wherein the means to secure the receptacle to the clip is a friction fit between the receptacle and the clip provided by the clip having a depending lip along the periphery of the second portion of the clip opening to engage the ears of the receptacle.

* * * * *